US009163891B1

(12) United States Patent
Dater et al.

(10) Patent No.: US 9,163,891 B1
(45) Date of Patent: Oct. 20, 2015

(54) FLASH HIDER FOR FIREARM SUPPRESSOR

(71) Applicants: Philip H. Dater, Boise, ID (US); Gregory Felton, St. Albans (GB)

(72) Inventors: Philip H. Dater, Boise, ID (US); Gregory Felton, St. Albans (GB)

(73) Assignees: LAW ENFORCEMENT INTERNATIONAL LTD, St. Albans, Herts (GB); ANTARES TECHNOLOGIES, INC., Boise, ID (US)

( * ) Notice: Subject to any disclaimer, the term of this patent is extended or adjusted under 35 U.S.C. 154(b) by 0 days.

(21) Appl. No.: 14/477,691

(22) Filed: Sep. 4, 2014

(51) Int. Cl.
*F41A 21/32* (2006.01)
*F41A 21/34* (2006.01)
*F41A 21/30* (2006.01)

(52) U.S. Cl.
CPC ..... *F41A 21/34* (2013.01); *F41A 21/30* (2013.01)

(58) Field of Classification Search
CPC ..... F41A 21/30; F41A 21/32; F41A 21/34; F41A 21/36
USPC ..... 89/14.2, 14.3, 14.4; D22/108; 42/1.06
See application file for complete search history.

(56) References Cited

U.S. PATENT DOCUMENTS

| | | | | | |
|---|---|---|---|---|---|
| 1,333,403 | A * | 3/1920 | Galliot et al. | ..... | 89/14.3 |
| 1,487,312 | A | 3/1924 | Bull | | |
| 2,351,037 | A * | 6/1944 | Green | ..... | 89/14.5 |
| 2,489,953 | A * | 11/1949 | Burney | ..... | 102/380 |
| 2,712,193 | A * | 7/1955 | Mathis | ..... | 42/79 |
| 2,985,074 | A | 5/1961 | Musser | | |
| 3,368,453 | A * | 2/1968 | Shaw | ..... | 89/14.3 |
| 4,583,445 | A * | 4/1986 | Blair | ..... | 89/14.2 |
| 4,930,396 | A * | 6/1990 | Johnson | ..... | 89/14.3 |
| 5,092,223 | A * | 3/1992 | Hudson | ..... | 89/14.2 |
| 5,136,923 | A | 8/1992 | Walsh, Jr. | | |
| 8,453,789 | B1 * | 6/2013 | Honigmann et al. | ..... | 181/223 |
| 8,459,405 | B1 | 6/2013 | Dueck | | |
| D720,031 | S * | 12/2014 | Buffoni | ..... | D22/108 |
| 9,080,829 | B1 * | 7/2015 | Cellini | ..... | 1/1 |
| 2010/0257996 | A1 * | 10/2010 | Noveske | ..... | 89/14.2 |
| 2010/0294118 | A1 * | 11/2010 | Hortobagyi | ..... | 89/14.2 |
| 2011/0271575 | A1 * | 11/2011 | Overbeek Bloem et al. | ..... | 42/90 |
| 2015/0192379 | A1 * | 7/2015 | Larson, Jr. | ..... | 89/14.3 |

* cited by examiner

*Primary Examiner* — Bret Hayes

(74) *Attorney, Agent, or Firm* — Parsons Behle & Latimer

(57) ABSTRACT

A flash hider that suppresses the visible flash signature during the discharge of a firearm, the flash hider may be connected to an end of a firearm suppressor. The flash hider includes a body having a first end, a second end, and a projection that extends from the second end. The flash hider has a central bore having a first portion and a second portion, the second portion being tapered. The flash hider may include a first plurality of apertures through the projection and a plurality of annular grooves on an inner surface of the projection. The flash hider may include a second plurality of apertures located within the second portion of the central bore and a plurality of flow ports connecting the second plurality of apertures to a third plurality of apertures located in the first end of the body.

16 Claims, 4 Drawing Sheets

FLASH HIDER FOR FIREARM SUPPRESSOR

FIELD OF THE DISCLOSURE

The embodiments described herein relate to a flash hider for a firearm suppressor.

BACKGROUND

Description of the Related Art

A suppressor may be used to reduce the noise made during the discharge of a firearm. In addition to producing a noise during discharge, a firearm has a flash signature, which is created by burning gases that exit the muzzle or barrel during discharge of the firearm. While a suppressor may reduce the discharge noise, a suppressor may not be configured to reduce the flash discharge.

Accordingly, there is a need to provide a flash hider that may be used with a firearm suppressor that reduces the flash signature during discharge of a firearm. Further, there may be a need to provide a flash hider that may be used in various firearm suppressors. Other drawbacks and disadvantages of present flash hiders may exist.

SUMMARY

The present disclosure is directed to a flash hider that suppresses the visible flash signature during the discharge of a firearm. The flash hider, which reduces the flash visible upon discharge, may be connected to the end of a firearm suppressor that reduces the noise due to discharge of the firearm. The flash hider may address some of the problems and disadvantages discussed above. The flash hider may reduce the flash signature by diverting at least a portion of the burning gases away from the exit of the suppressor.

One embodiment is a flash hider for a firearm comprising a body having a first end, a second end, and a projection that extends from the second end. The body may be a circular body and the projection may be a cylindrical projection. The flash hider comprises a central bore through the body and the projection, the central bore having a first portion and a second portion, the first portion being adjacent the projection, the second portion being tapered and being adjacent to the first end of the body. The flash hider comprises a flange on an outer portion of the body, the flange extends from the second end of the body, wherein the flange forms a recess between an inner surface of the flange and an outer surface of the projection. The first portion of the central bore may have a constant inner diameter and the second portion of the central bore may have a conical inner diameter.

The flash hider may include threads on an outer surface of the flange. The flash hider may include a first plurality of apertures through the cylindrical projection. The flash hider may include a plurality of annular grooves on an inner surface of the cylindrical projection. The first plurality of apertures may be located within one of the plurality of annular grooves on the inner surface of the cylindrical projection. The first plurality of apertures may be positioned equilaterally around the cylindrical projection. The first plurality of apertures may comprise four apertures. The plurality of annular grooves may comprise a lower groove, a middle groove, and an upper groove and wherein the first plurality of apertures may be located within the middle groove.

The flash hider may include a second plurality of apertures located within the second portion of the central bore. The flash hider may include a plurality of flow ports and a third plurality of apertures located in the first end of the body, wherein each flow port connects one of the second plurality of apertures with one of the third plurality of apertures. The flash hider may include a plurality of grooves in the first end of the body, each groove of the plurality of grooves being connected to one of the third plurality of apertures located in the first end of the body. The second plurality of apertures may be positioned equilaterally around the second portion of the central bore. The second plurality of apertures may comprise three apertures, the third plurality of apertures may comprise three apertures, and the plurality of grooves in the first end of the body may comprise three grooves. The first end of the body may include a flat inner surface adjacent the central bore and a beveled outer surface adjacent the flange. The third plurality of apertures may be positioned within the flat inner surface and the plurality of grooves in the first end of the body may extend from the third plurality of apertures into the beveled outer surface of the first end of the body.

One embodiment is a suppressor for a firearm comprising a housing having a first end and a second end, the first end adapted to be connected to a barrel of a firearm, the housing adapted to suppress a noise during the discharge of a firearm. The suppressor comprises a flash hider connected to the second end of the housing, the flash hider comprising a circular body having a first end, a second end, and a cylindrical projection that extends from the second end. The flash hider comprises a central bore through the body and the cylindrical projection, the central bore having a first portion and a second portion, the first portion being adjacent the cylindrical projection having a constant inner diameter, the second portion having a conical inner diameter and being adjacent to the first end of the body. The flash hider comprises a threaded flange on an outer portion of the body.

The suppressor may include a first plurality of apertures through the cylindrical projection and at least one annular groove on an inner surface of the cylindrical projection, wherein the first plurality of apertures are positioned within the annular groove. The suppressor may include a shoulder on the second end of the circular body adjacent to the threaded flange, wherein the second end of the housing is positioned against the shoulder. The suppressor may include a second plurality of apertures positioned within the second portion of the central bore connected to a third plurality of apertures in the first end of the circular body. The suppressor may include a plurality of grooves in the first end of the circular body connected to the third plurality of apertures.

Figure 1:
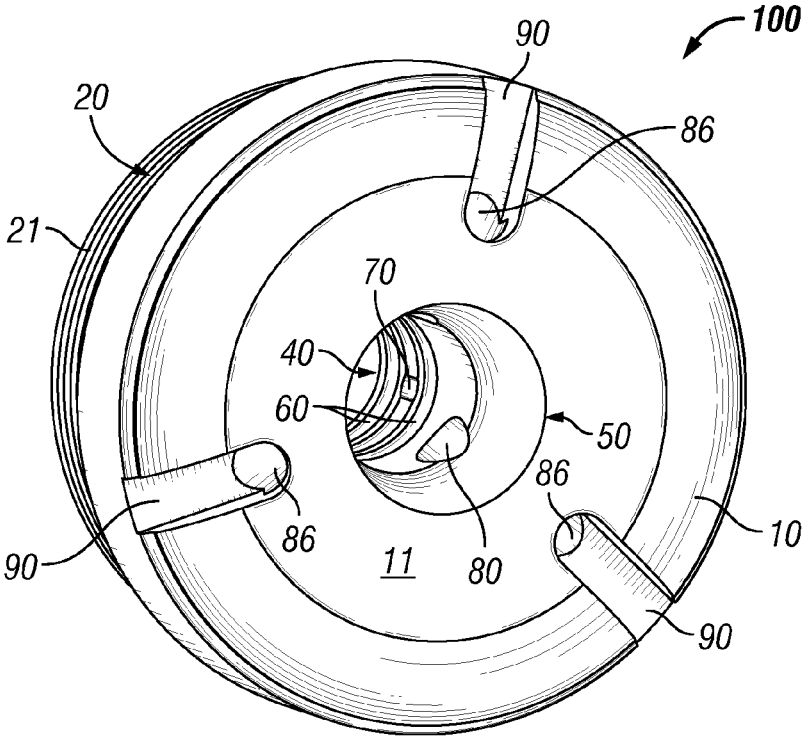
FIG. 1 shows a front isometric view of one embodiment of a flash hider.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
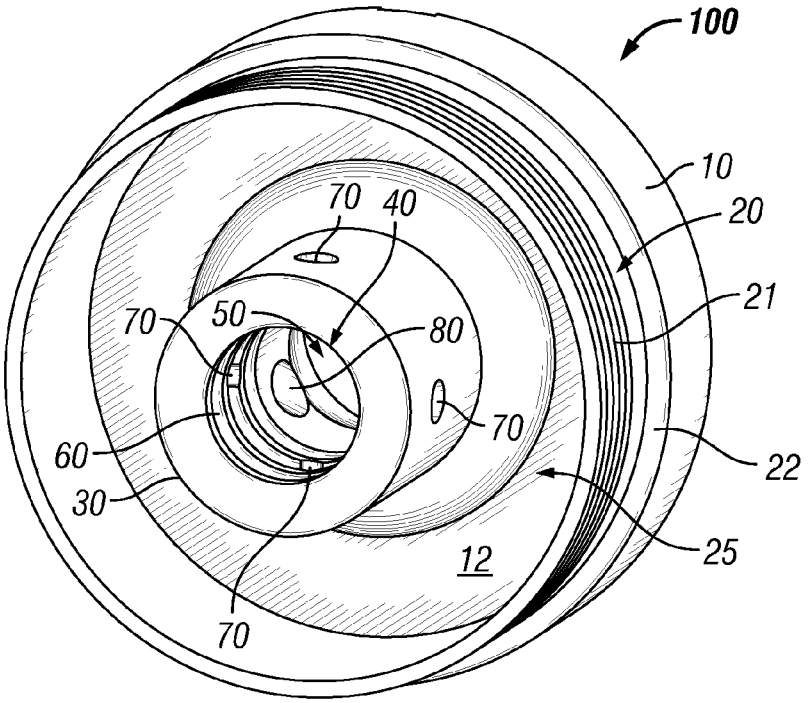
FIG. 2 shows a rear isometric view of one embodiment of a flash hider.

FIG. 1 shows an embodiment of a flash hider 100 that may be used to reduce the flash signature during the discharge of a firearm. The flash hider 100 is comprised of a body 10, which may be a circular body as shown in FIG. 1. Circular, as used herein, includes all bodies that are circular, substantially circular, or other shapes that may be used in connection with a firearm suppressor as would be recognized by one of ordinary skill in the art having the benefit of this disclosure. The body 10, also referred to herein as a circular body, includes a first, or front, end 11 and a second, or rear, end 12 (shown in FIG. 2). A projection 30, as shown in FIG. 2, extends from the second end 12 of the body 10. The projection 30 may be cylindrical as shown in FIG. 2. The body 10 includes a central bore that also extends through the projection 30. The first portion 40 of the central bore is substantially positioned within the projection 30 and the second portion 50 that is tapered and is substantially positioned within the circular body 10. For example, the first portion 40 of the central bore may have a substantially constant inner diameter and the second portion may have a substantially conical inner diameter. The first and second portions 40 and 50 of the central bore may not be circular. For example the central bore may be triangular, square, pentagonal or various other shapes as would be appreciated by one of ordinary skill in the art having the benefit of this disclosure with the second portion 50 be a tapered shape that corresponds to the shape of the first portion 40.

The body 10 includes a flange 20 that extends from the second end 12 of the body 10. The flange 20 may include exterior threads 21 that permit the connection of the flash hider 100 to a firearm suppressor 200 (shown in FIG. 6). The end of the firearm suppressor 200 may abut against a shoulder 22 on the second end 12 of the body 10. When attached to a firearm suppressor 200, the gasses from the discharge of ammunition may travel into the first portion 40 of the central bore in the projection 30, travel through the second portion 50 of the central bore in the body 10, and out the body 10.

The projection 30 includes a first plurality of apertures 70 that may permit the flow of gas from the first portion 40 of the central bore outside of the projection 30. A portion of the flow of gas may enter into a cylindrical recess 25 between the projection 30 and the flange 20 (shown in FIG. 2). The first plurality of apertures 70 may be positioned equilaterally around the projection 30, as shown in FIG. 2. The first plurality of apertures 70 may include a various number, size, and configuration of apertures 70 as would be appreciated by one of ordinary skill in the art having the benefit of this disclosure. The projection 30 may include four apertures 70 positioned approximately ninety (90) degrees apart around the perimeter of the projection 30 as shown in FIG. 2. The inner surface of projection 30 may include a plurality of annular grooves 60. FIG. 2 shows three annular grooves 60, but the number, size, and location along the projection 30 may be varied as would be appreciated by one of ordinary skill in the art having the benefit of this disclosure. The first plurality of apertures 70 may be positioned within one of the plurality of annular grooves 60. The inner surface of the projection 30 may include three annular grooves 60 with the apertures 70 positioned within the middle groove 60 as shown in FIGS. 1 and 2.

Figure 3:
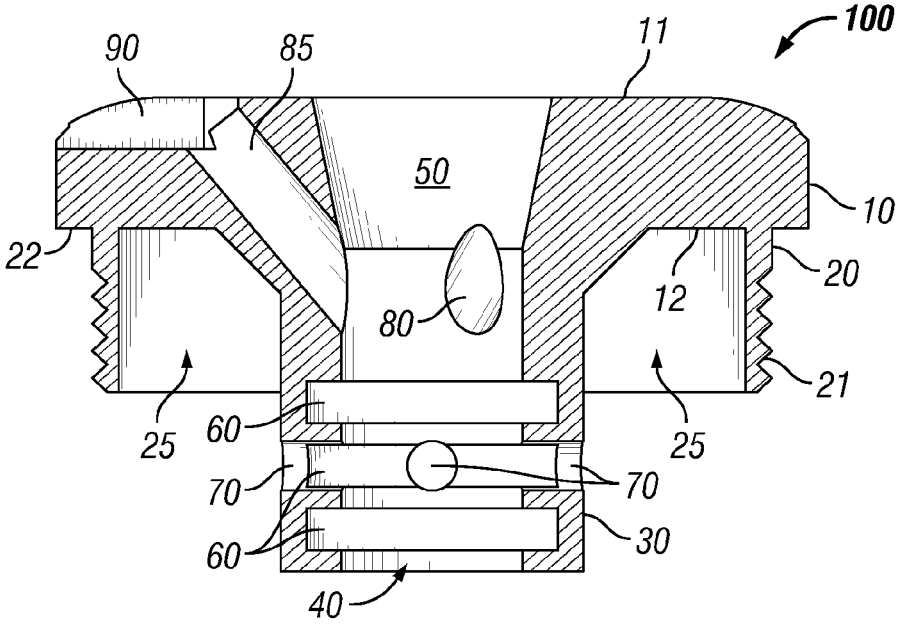
FIG. 3 shows a cross-sectional view of one embodiment of a flash hider.
Figure 4:
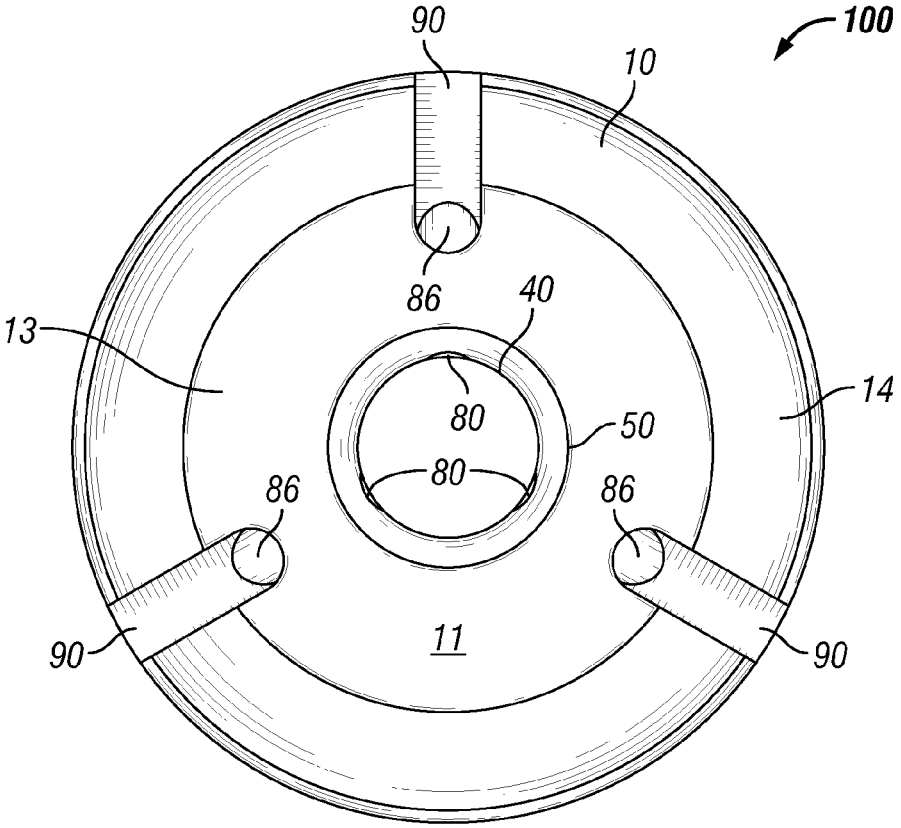
FIG. 4 shows a front view of one embodiment of a flash hider.

The body 10 may include a second plurality of apertures 80 positioned substantially within the second portion 50 of the central bore. The aperture 80 may be positioned equilaterally around the second portion 50 of the central bore, as shown in FIG. 4. The body may include a third plurality of apertures 86 on the first side 11 of the body 10. Each aperture 80 of the second plurality of apertures 80 is connected to a single aperture 86 of the third plurality of apertures 86 via a flow port 85, as shown in FIG. 3. The second plurality of apertures 80, flow ports 85, and third plurality of apertures 86 may permit the flow of gas from the second portion 50 of the central bore out of the central bore through the apertures 86. The flow of gas away from the central flow bore during the discharge of a firearm may reduce the flash signature during discharge. The first end 11 of the body 10 of the flash hider 100 may include a plurality of grooves 90 with each of the grooves 90 being connected with an aperture 86 of the third plurality of apertures 86 in the first end 11 of the body 10.

FIG. 3 shows a cross-section of an embodiment of a flash hider 100 having a cylindrical body 10. As shown a central bore extends from a second end 12 of the body 10 to a first end of the body 11. The central bore has a first portion 40 having a substantially constant inner diameter and a second portion 50 having a substantially conical inner diameter. The projection 30 may include a plurality of annular grooves 60 on the inner surface of the projection. As shown, there may be three annulus grooves 60 and first plurality of apertures 70 may be positioned within the middle annular groove 60. A flange 20 extends from the second end 12 of the body 10. Threads 21 on the flange 20 permit the connection of the flash hider 100 to a firearm suppressor 200 (shown in FIG. 6). A portion of the firearm suppressor 200 may abut against shoulder 22 on the second end 12 of the body 10. The flange 20 and projection 30 define a cavity 25 between each other on the second side 12 of the body 10.

The body 10 includes a second plurality of apertures 80 that are connected via a plurality of flow ports 85 to a third plurality of apertures 86 (shown in FIG. 1) in the first end 11 of the body 10. The second plurality of apertures 80 may be located entirely within the first portion 40 of the central bore, may be located entirely within the second portion 50 of the central bore, or may be located with a portion of the aperture 80 in both the first portion 40 and second portion 50 of the central bore, as shown in FIG. 3. The first end 11 of the body 10 includes a plurality of grooves 90 connected to the third plurality of apertures 86 (shown in FIG. 1).

FIG. 4 shows a front view of an embodiment of a flash hider 100. The first, or front, end 11 of the body 10 may include a substantially planer portion 13 and a substantially beveled portion 14. The first end 11 may include a plurality of grooves 90 connected to a plurality of apertures 86. The grooves 90 may traverse at least a portion of both the planar portion 13 and the beveled portion 14 of the first end 11. As shown in FIG. 4, the body 10 may include a plurality of apertures 80 located equilaterally around a central bore that extends through the flash hider 100. The central bore may have a first portion 40 having a substantially constant diameter and a second portion 50 having a substantially conical diameter.

Figure 5:
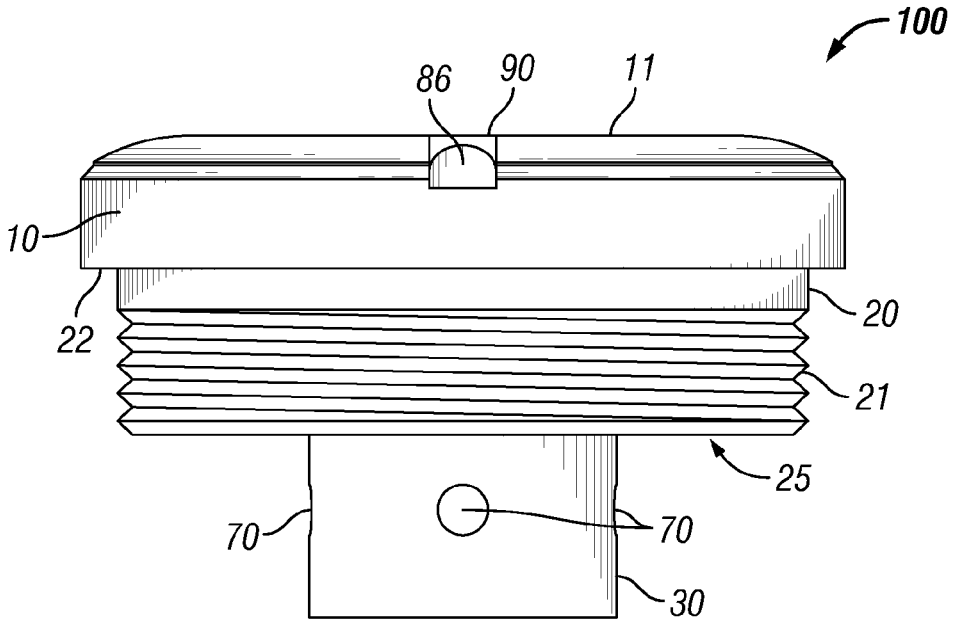
FIG. 5 shows a side view of one embodiment of a flash hider.

FIG. 5 shows a side view of an embodiment of a flash hider 100. The flash hider 100 includes a body 10 having a plurality of apertures 86 and grooves 90 in a first side 11. A projection 30 and a flange 20 both extend from a second side 12 (shown in FIG. 2) with a recess 25 being positioned between the projection 30 and the flange 20. The flange 20 may include exterior threads 21 and may form a shoulder 22 in the body 10 of the flash hider 100. The projection 30 may include a plurality of apertures 70 that permit communication between the exterior and interior of the projection 30.

Figure 6:
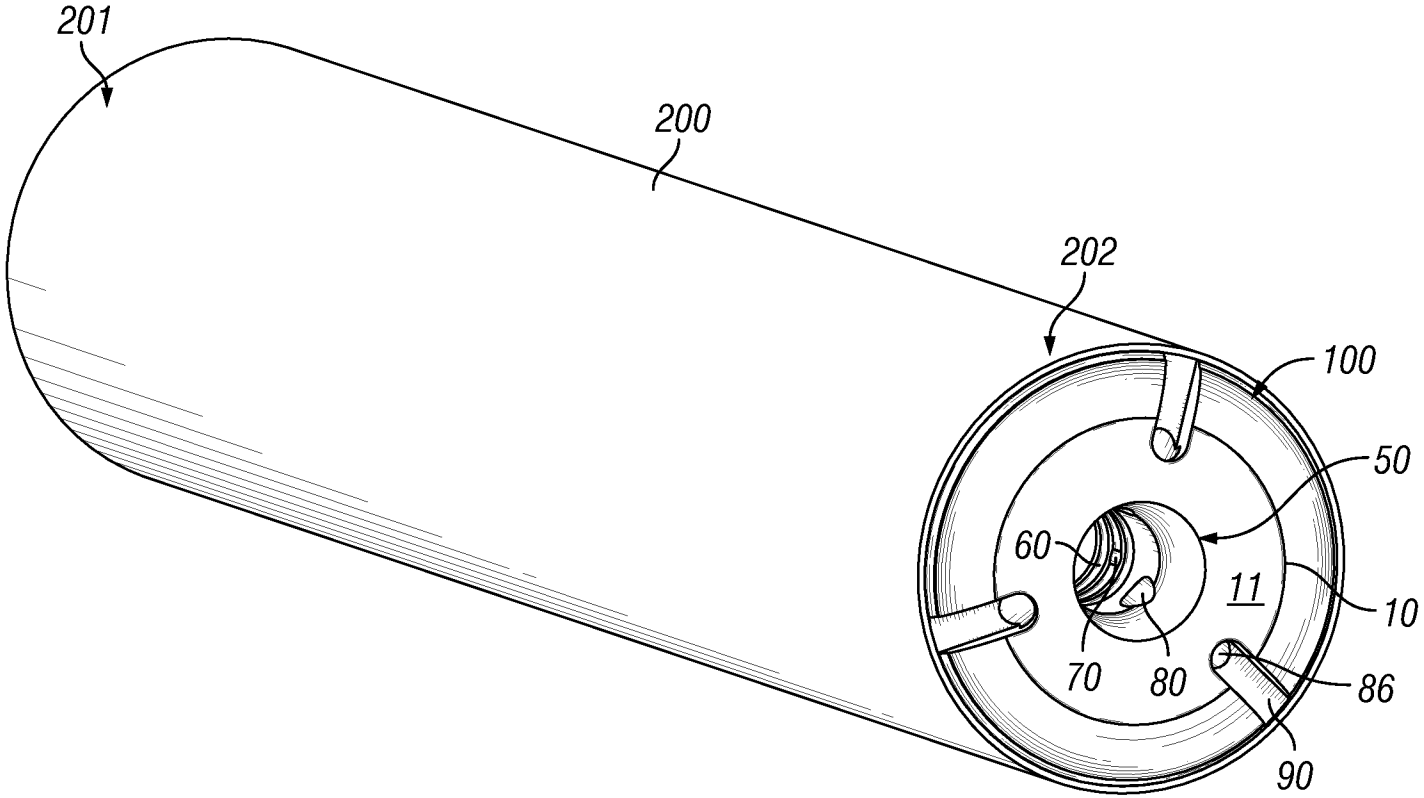
FIG. 6 shows an isometric view of one embodiment of a flash hider installed on a firearm suppressor.

FIG. 6 shows a firearm suppressor 200 having a first end 201 adapted to be connected to a barrel of a firearm and having a second end 202. The suppressor 200 may be various suppressors configured to reduce the noise created during the discharge of a firearm as would be appreciated by one of ordinary skill in the art having the benefit of this disclosure. For example, the suppressor 200 may be a sound suppressor as disclosed in U.S. Pat. No. 7,308,967 entitled Sound Suppressor, which is incorporated by reference herein in its entirety. An embodiment of a flash hider 100 is connected to the second end 202 of the suppressor 200. The central bore of the flash hider 100 is aligned with the barrel of the firearm as well as a bullet path through the suppressor 200. The bullet fired from a firearm may exit the suppressor 200 and flash hider 100 assembly through the second portion 50 of the central bore. The use of annular grooves 60, first apertures 70, second apertures 80, third apertures 86, and grooves 90 in the front side 11 of the body 10 permit the flow of discharge gas away from the central bore of the flash hider 100 reducing the flash signature when a firearm is discharged.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A flash hider for a firearm comprising:

a body having a first end, a second end, and a projection that extends from the second end;

a central bore through the body and the projection, the central bore having a first portion and a second portion, the first portion being adjacent the projection, the second portion being tapered and being adjacent to the first end of the body; and a flange on an outer portion of the body with threads on an outer surface of the flange, the flange extends from the second end of the body, wherein the flange forms a recess between an inner surface of the flange and an outer surface of the projection;

wherein the first portion of the central bore has a constant inner diameter and the second portion of the central bore has a conical inner diameter;

wherein the body further comprises a circular body and wherein the projection further comprises a cylindrical projection having a first plurality of apertures through the cylindrical projection and a plurality of grooves on an inner surface of the cylindrical projection.

2. The flash hider of claim 1, wherein the first plurality of apertures are located within one of the plurality of annular grooves on the inner surface of the cylindrical projection.

3. The flash hider of claim 2, wherein the first plurality of apertures are positioned equilaterally around the cylindrical projection.

4. The flash hider of claim 3, wherein the first plurality of apertures comprises four apertures.

5. The flash hider of claim 3, wherein the plurality of annular grooves on the inner surface of the cylindrical projection comprises a lower groove, a middle groove, and an upper groove and wherein the first plurality of apertures are located within the middle groove.

6. The flash hider of claim 3, further comprising a second plurality of apertures located within the second portion of the central bore.

7. The flash hider of claim 6, further comprising a plurality of flow ports and a third plurality of apertures located in the first end of the body, wherein each flow port connects one of the second plurality of apertures with one of the third plurality of apertures.

8. The flash hider of claim 7, further comprising a plurality of grooves in the first end of the body, each groove of the plurality of grooves being connected to one of the third plurality of apertures located in the first end of the body.

9. The flash hider of claim 8, wherein the second plurality of apertures are positioned equilaterally around the second portion of the central bore.

10. The flash hider of claim 9, wherein the second plurality of apertures comprises three apertures, the third plurality of apertures comprises three apertures, and the plurality of grooves in the first end of the body comprises three grooves.

11. The flash hider of claim 8, wherein the first end of the body comprises a flat inner surface adjacent the central bore and a beveled outer surface adjacent the flange.

12. The flash hider of claim 11, wherein the third plurality of apertures are positioned within the flat inner surface and wherein the plurality of grooves in the first end of the body extend from the third plurality of apertures into the beveled outer surface of the first end of the body.

13. A suppressor for a firearm, the suppressor comprising:

a housing having a first end and a second end, the first end adapted to be connected to a barrel of a firearm, the housing being adapted to suppress a noise during the discharge of a firearm; and a flash hider connected to the second end of the housing, the flash hider comprising:

a circular body having a first end, a second end, and a cylindrical projection that extends from the second end;

a central bore through the body and the cylindrical projection, the central bore having a first portion and a second portion, the first portion being adjacent the cylindrical projection and having a constant inner diameter, the second portion having a conical inner diameter and being adjacent to the first end of the body;

a first plurality of apertures through the cylindrical projection and at least one annular groove on an inner surface of the cylindrical projection, wherein the first plurality of apertures are positioned within the annular groove; and a threaded flange on an outer portion of the body.

14. The suppressor of claim 13, further comprising a shoulder on the second end of the circular body adjacent to the threaded flange, wherein the second end of the housing is positioned against the shoulder.

15. The suppressor of claim 14, further comprising a second plurality of apertures positioned within the second portion of the central bore connected to a third plurality of apertures in the first end of the circular body.

16. The suppressor of claim 15, further a plurality of grooves in the first end of the circular body connected to the third plurality of apertures.

* * * * *